US005299833A

United States Patent [19]

Madole, Jr.

[11] Patent Number: 5,299,833

[45] Date of Patent: Apr. 5, 1994

[54] PAPER SHEETS WITH PRESSURE SENSITIVE ADHESIVE FORMING AN EASEL PAD

[75] Inventor: Richard F. Madole, Jr., Stillwater, Okla.

[73] Assignee: Moore Business Forms, Inc., Grand Island, N.Y.

[21] Appl. No.: 51,872

[22] Filed: Apr. 26, 1993

[51] Int. Cl.[5] ..... B42D 1/00

[52] U.S. Cl. ..... 281/2; 281/38; 428/42; 428/43

[58] Field of Search ..... 281/2, 3.1, 5, 15.1, 281/38, 51; 283/61; 428/40, 41, 42, 43; 40/299, 630

[56] References Cited

U.S. PATENT DOCUMENTS 4,590,109 5/1986 Holmberg .
4,822,074 4/1989 Hueffman et al. ..... 281/15.1
4,884,826 12/1989 Slagsvol .
4,980,212 12/1990 Marquis et al. .
5,153,041 10/1992 Clements et al. .
5,227,209 7/1993 Garland ..... 283/105 X

FOREIGN PATENT DOCUMENTS 0309107 3/1989 European Pat. Off. .
3836795 5/1990 Fed. Rep. of Germany ..... 281/2

*Primary Examiner*—Mark Rosenbaum
*Assistant Examiner*—Willmon Fridie, Jr.
*Attorney, Agent, or Firm*—Nixon & Vanderhye

[57] ABSTRACT

Discrete overlying sheets form a pad or chart with the sheets secured one to another along an upper margin. Strips of repositional adhesive are coated along the back side of each sheet adjacent the upper margin between weak and strong lines of perforations. The top sheet may be removed from the pad or chart by tearing along the weak line of perforations and adhered to a support surface using the repositional adhesive. The sheet may subsequently be removed from the support surface by tearing along the strong line of perforations. The ends of the lines of adhesive may be formed in various patterns to provide additional coated areas or additional uncoated areas.

14 Claims, 2 Drawing Sheets

PAPER SHEETS WITH PRESSURE SENSITIVE ADHESIVE FORMING AN EASEL PAD

TECHNICAL FIELD

The present invention relates to pads of paper sheets secured one to the other along marginal portions to form a flip chart pad and particularly relates a flip chart pad having repositional adhesive on the back side of the paper sheets forming the pad such that the discrete sheets can be removed from the pad and adhered to another surface.

BACKGROUND

Conventional flip charts or easel pads typically require a multiplicity of superposed sheets fastened together along a margin, usually at the top, and secured to a backing sheet or other support whereby the sheets depending from the margin can be flipped over the chart or torn from the pad. Often, it is desirable to remove one or more of the sheets from the chart as they are being used and to post the removed sheets, for example, by taping the removed sheets to a wall surface. This is an awkward procedure at best and frequently requires two individuals to tape the removed sheet to the wall surface.

DISCLOSURE OF THE INVENTION

In accordance with the present invention, there is provided a chart or easel pad comprised of a plurality of sheets, preferably paper, bound to one another along a margin, usually the top margin of the pad, to hold the sheets together in a pad-type arrangement. Staples or other fasteners are conventionally provided to secure the sheets to one another along the margin and to a backing support or other support for the pad. In accordance with this invention, repositional adhesive is applied along the back sides of the sheets inwardly of or below the binding for the sheets, generally in the form of a horizontal strip adjacent the bound margin of the sheet, so that the individual sheets may be removed from the pad and adhered to another supporting surface, such as a wall. To facilitate the removal of each sheet from the pad, a first line of perforations extends across each sheet between the binding and repositional adhesive. A second perforation line is also provided below the adhesive so that the sheet may be torn along the second perforation line and removed from the adhesive securing the sheet to the wall support. Thus, the sheet removed from the wall support may be used as a permanent record without portions of the sheet sticking to itself. Preferably, the second line of perforations is a stronger line of perforations than the first line of perforations so that the sheet may be initially easily removed or torn from the pad with the assurance that the removed sheet will contain the adhesive strip, as well as the second line of perforations.

An additional feature of the present invention resides in the provision of additional adhesive along the lateral edges of the sheet. When a user grasps the sheet to remove it from the pad, oils from the user's hand typically adhere to the adhesive, decreasing its adhesive properties when the sheet is adhered to another supporting surface. Also, the sheets often curl at the corners when the leading edge or lateral margins of the sheets are removed from the pad. With an enlarged adhesive area along one or both of the lateral margins of the sheets, the adherence of the sheets to the support surface is maintained while compensating for the deleterious effect of the oils from the individual's hand.

Still further, marginal edge areas of the strip of repositional adhesive may have areas uncoated with adhesive to enable the sheet to be grasped by an individual's fingers without engaging the adhesive. This also lessens the adhesive quality of the adhesive adjacent the lateral edges of the sheet thereby facilitating removal of the sheet from a support surface without marring the support surface. Further, the final sheet in the pad may have the back side fully or partially coated with repositional adhesive with or without a release liner. In this manner, the pad may be mounted initially to a wall surface, eliminating the need for a stand.

In a preferred embodiment according to the present invention, there is provided a pad comprising a plurality of discrete paper sheets in registration with and overlying one another, means along registering margins of the sheets for securing the sheets to one another to form a generally rectilinear pad containing the sheets, a first separation line extending generally parallel to and inwardly of the registering margins of the sheets and a second separation line extending generally parallel to the first separation line and spaced inwardly therefrom. Repositional adhesive is disposed on a face portion of each sheet between the separation lines whereby each sheet may be removed from the pad along the first separation line, adhesively secured to a surface and subsequently removed from the surface along the second separation line.

Accordingly, it is a primary object of the present invention to provide a novel and improved easel pad or flip chart having repositional adhesive on the back sides of the individual sheets so that the sheets may be removed from the pad or chart and applied to a supporting surface.

BEST MODE FOR CARRYING OUT THE INVENTION

Figure 1:
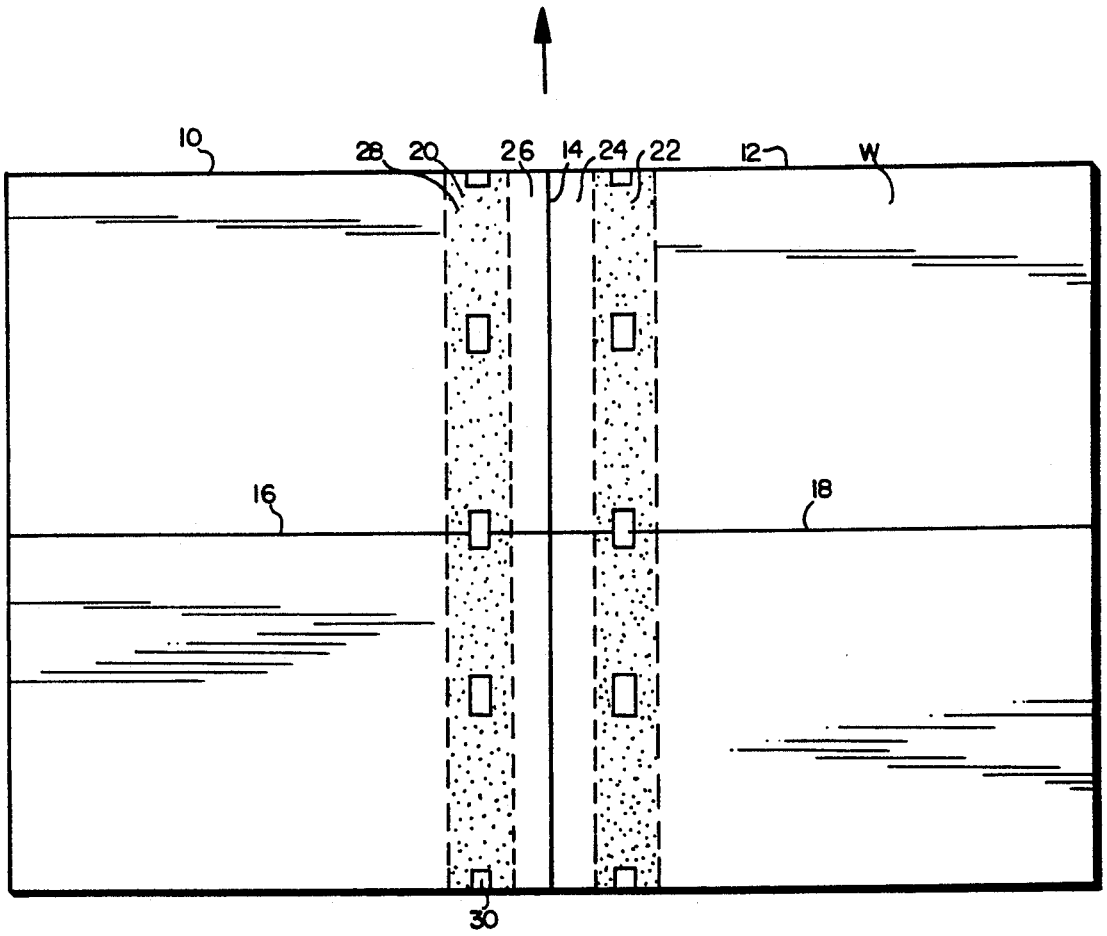
FIG. 1 is a plan view of a web of paper from which individual sheets are formed for inclusion in a pad or flip chart in accordance with the present invention.

Referring now to the drawings, particularly to FIG. 1, there is illustrated a web W of paper travelling in a machine direction indicated by the arrow. As illustrated, web W has a plurality of successive panels 10 and 12 in side-by-side relation one to the other and connected to one another along a longitudinal centerline 14 and along which centerline 14 the discrete sheets 10 and 12 are cut and collated to form a pad of sheets S. The individual panels 10 and 12 are likewise cut or burst transversely along cut lines or lines of perforation 16 and 18 to separate the sheets S longitudinally one from the other in the direction of web travel.

Each sheet S contains on its back or rear face a strip of repositional adhesive 20 and 22 inset from the longitudinal cut line 14 and extending between the opposite longitudinally spaced margins of sheets S. In terms of the pad or chart comprising the individual sheets S when assembled, the strips of adhesive extend transversely on the rear face of each sheet from opposite lateral margins of the pad and are inset from the top of the pad to define an uncoated strip 24 between the top margin of the pad and the strip of adhesive on the pad. Once the sheets are cut or burst from the web and collated, they are secured in pad form one to the other by any suitable fastening means, such as staples or screws with wingnuts, which pass through the registering uncoated strips 24.

Separation lines, e.g., lines of perforation 26 and 28, are disposed along opposite sides of the adhesive strips 20, the line of perforations 26 being closer to the top edge of the pad than the line of perforations 28. For reasons which will become apparent, the lines of perforation 26 are weaker than the lines of perforations 28. The separation lines may comprise types of weakening of the paper other than lines of perforations 26 and 28.

When the sheets S are assembled and secured in pad form, it will be appreciated that the front faces of the sheets, except for the binding at the top of the pad, are uncoated and clear and may be written upon by a user. The user may flip the sheet S over the top margin of the chart so that second and subsequent sheets may be utilized. In the event that it is desirable to mount one or more of the sheets on another supporting surface, for example, an adjacent wall, each sheet can be torn along the weak perforation line 26 to expose the underlying strip of adhesive by which the removed sheet may be adhered to a supporting surface. It may also be desirable to subsequently remove the sheet from the supporting surface to which it is adhesively secured. To accomplish this, the sheet may be torn along the strong line of perforations 28, leaving the strip with the adhesive on its back side adhered to the supporting wall surface. Thus, the removed sheet may form part of a record without any adhesive on either side.

Referring to FIG. 1, it will be appreciated that selected areas of the adhesive strip may be uncoated with adhesive. For example, the areas 30 at the ends of the adhesive strip along the lateral margins of the sheets may be uncoated. The uncoated areas 30 at the margins of the discrete sheets of the pad facilitate gripping the individual sheets between the user's fingers and removal of each sheet from the underlying paper sheet. Oil residue from the user's fingers is left on the uncoated areas and thus do not deleteriously affect the quality of the adhesive or its adhesive strength. Also, the uncoated areas adjacent the sheet margins lessen any tendency of the adhesive to leave residue on the support surface or to remove paint from the support surface upon removal of the adhesive strip. The adhesive is applied to the web by coating wheels which have areas in which adhesive is not applied to the wheel and hence to the web and which areas are timed with the advance of the web to ensure that portions of the margins of the discrete sheets of the pad are left uncoated.

Figure 2:
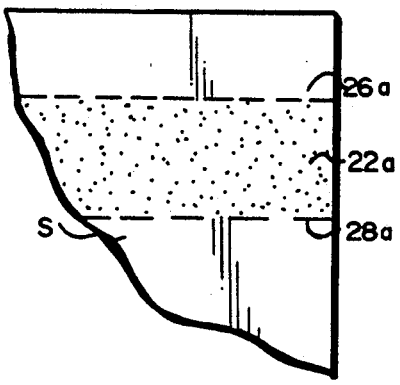
FIG. 2 is an enlarged fragmentary elevational view of the rear face of a sheet adjacent the upper margin illustrating the repositional adhesive.

Referring now to FIG. 2, there is illustrated a strip of adhesive **22*a* which extends fully to the opposite lateral margins of the sheet. The weak and strong lines of perforation 26*a* and 28*a***, respectively, are also illustrated.

Figure 3:
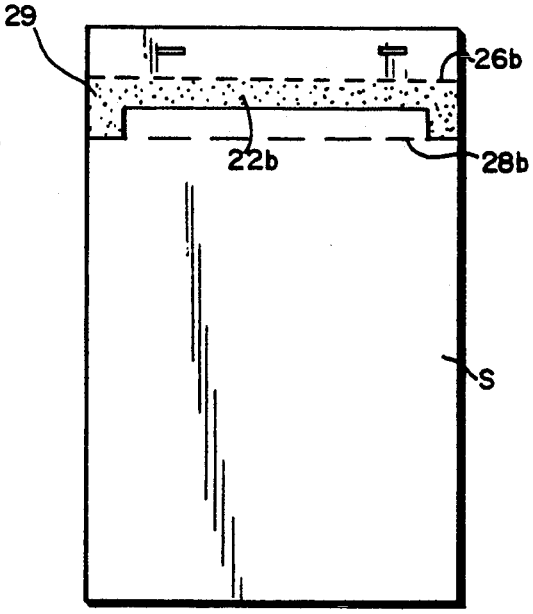
FIG. 3 is a rear elevational view of the rear face of a sheet forming part of the easel pad or flip chart illustrating a further form of application of adhesive thereto.

In FIG. 3, an inverted, generally U-shaped, adhesive pattern is disposed between the weak and strong lines of perforations **26*b* and 28*b*, respectively. The legs 29 of adhesive pattern 22*b* extend longitudinally fully between the lines of perforation, while the base of the U-shaped adhesive pattern lies short of the strong line of perforations 28*b***. In this manner, and with the lines of perforations are spaced one from the other a greater difference than in the prior embodiments, the enlarged adhesive areas in the edge regions of the sheets improve adherence of the sheets to the support surface, ensuring that the sheet will remain attached to the wall and also ensuring that any areas of the adhesive which have been degraded by contact with the oils of an individual's fingers will have sufficient remaining adhesive qualities to ensure that the sheet remains adhesively secured to the supporting surface. The generally U-shaped adhesive pattern may, of course, be reversed from that shown into a generally upright U-shape.

Figure 4:
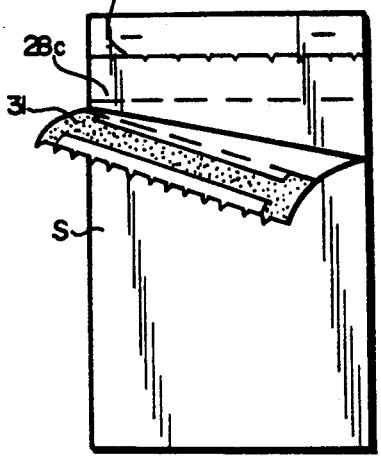
FIG. 4 is a front view of a pad or chart constructed in accordance with the present invention with the front sheet curled down to illustrate the adhesive coating along its upper margin.

Referring to FIG. 4, there is illustrated a still further form of adhesive pattern applied to the back face of the individual sheets. Here, a thin line of adhesive extends between the opposite lateral margins of the sheet, with enlarged end areas 31 formed by extending the adhesive longitudinally along the margins of the sheet but between the weak and strong lines of perforations **26*c* and 28*c***, respectively.

Figure 5:
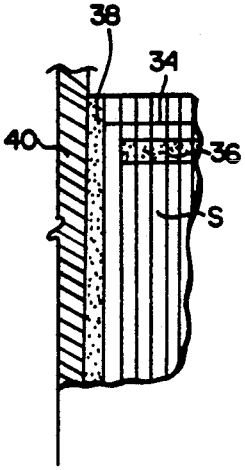
FIG. 5 is a fragmentary cross-sectional view illustrating the manner in which the individual sheets are secured one to the other and the location of the repositional adhesive.

Referring to FIG. 5, there is illustrated a plurality of sheets S in pad or chart form secured one to the other, for example, by staples 34 passing through the sheets. The strips of adhesive along the back sides of each of these sheets are illustrated at 36. In this form, the final sheet S in the pad has repositional adhesive 38 coated along its entire back surface, or at least so much of its entire back surface as to permit the entire pad to be adhesively secured to a supporting surface 40, such as a wall.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A pad comprising:

a plurality of discrete paper sheets in registration with and overlying one another;

means along registering margins of said sheets for securing said sheets to one another to form a generally rectilinear pad containing said sheets;

a first separation line extending generally parallel to and inwardly of the registering margins of said sheets;

a second separation line extending generally parallel to said first separation line and spaced inwardly therefrom; and repositional adhesive disposed on a face portion of each sheet between said separation lines whereby each said sheet may be removed from the pad along said first separation line, adhesively secured to a surface and subsequently removed from the surface along the second separation line.

2. A pad according to claim 1 wherein said first and second separation lines comprise lines of perforations, said repositional adhesive being disposed along each sheet on a face thereof opposite to an exposed face thereof when said sheet is the top sheet on the pad.

3. A pad according to claim 1 wherein said first and second lines of separation are configured to require less force to separate the sheet from the margin along the first line of separation than the force required to separate the sheet from the face portion along the second line of separation.

4. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations.

5. A pad according to claim 1 wherein one side margin of each sheet has a greater quantity of said repositional adhesive therealong than the quantity of repositional adhesive intermediate said side edges.

6. A pad according to claim 1 wherein said side edges of each sheet have a lesser quantity of said repositional adhesive therealong than the quantity of repositional adhesive intermediate said side edges.

7. A pad according to claim 1 wherein at least one side edge portion of each said sheet between said first and second lines of perforation has an area free of repositional adhesive.

8. A pad according to claim 1 wherein said sheets are secured to one another only along said margins thereof such that the pad may serve as a flip chart with the sheets folded in succession about said margins.

9. A pad according to claim 1 wherein a last sheet of said paper sheets forming said pad has a quantity of adhesive on the reverse side thereof from the other sheets of said pad sufficient to adhesively secure said pad to a support surface.

10. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations, at least one side edge portion of each said sheet between said first and second lines of perforation having an area free of repositional adhesive.

11. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations, said sheets being secured to one another only along said margins thereof such that the pad may serve as a flip chart with the sheets folded in succession about said margins.

12. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations, at least one side edge portion of each said sheet between said first and second lines of perforation having an area free of repositional adhesive, a last sheet of said paper sheets forming said pad having a quantity of adhesive on the reverse side thereof from the other sheets of said pad sufficient to adhesively secure said pad to a support surface.

13. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations, said sheets being secured to one another only along said margins thereof such that the pad may serve as a flip chart with the sheets folded in succession about said margins, a last sheet of said paper sheets forming said pad having a quantity of adhesive on the reverse side thereof from the other sheets of said pad sufficient to adhesively secure said pad to a support surface.

14. A pad according to claim 1 wherein said first and second lines of separation comprise lines of perforations, said second line of perforations being configured to require a greater force to separate each sheet from said face portion than required to separate each sheet, including the face portion, from the margin along said first line of perforations whereby said sheet may be torn along the first line of perforations to remove the sheet from the pad without tearing along the second line of perforations, at least one side edge portion of each said sheet between said first and second lines of perforation having an area free of repositional adhesive, said sheets being secured to one another only along said margins thereof such that the pad may serve as a flip chart with the sheets folded in succession about said margins, a last sheet of said paper sheets forming said pad having a quantity of adhesive on the reverse side thereof from the other sheets of said pad sufficient to adhesively secure said pad to a support surface.

* * * * *